US009312087B2

(12) United States Patent
Yeon et al.

(10) Patent No.: US 9,312,087 B2
(45) Date of Patent: Apr. 12, 2016

(54) ELECTRONIC CONTACTOR INCLUDING SEPARABLE UPPER BODIES

(71) Applicant: HYUNDAI HEAVY INDUSTRIES CO., LTD, Ulsan (KR)

(72) Inventors: Young-Myoung Yeon, Cheongju-si (KR); Ki-Jeong Kwon, Ulsan (KR); Young-Ho Jin, Ulsan (KR); Jae-Hyuk Oh, Ulsan (KR)

(73) Assignee: HYUNDAI HEAVY INDUSTRIES CO., LTD, Ulsan (KR)

( * ) Notice: Subject to any disclaimer, the term of this patent is extended or adjusted under 35 U.S.C. 154(b) by 147 days.

(21) Appl. No.: 14/237,972

(22) PCT Filed: Dec. 21, 2012

(86) PCT No.: PCT/KR2012/011220

§ 371 (c)(1),
(2) Date: Feb. 10, 2014

(87) PCT Pub. No.: WO2014/051209

PCT Pub. Date: Apr. 3, 2014

(65) Prior Publication Data

US 2015/0061797 A1 Mar. 5, 2015

(30) Foreign Application Priority Data

Sep. 26, 2012 (KR) ..... 10-2012-0107373

(51) Int. Cl.
*H01H 9/02* (2006.01)
(Continued)

(52) U.S. Cl.
CPC ..... *H01H 50/16* (2013.01); *H01H 50/02* (2013.01); *H01H 50/04* (2013.01); *H01H 50/042* (2013.01); *H01H 50/047* (2013.01); *H01H 50/541* (2013.01); *H01H 51/06* (2013.01)

(58) Field of Classification Search
CPC ..... H01H 50/16; H01H 50/04; H01F 7/088
USPC ..... 335/202, 255, 257
See application file for complete search history.

(56) References Cited

U.S. PATENT DOCUMENTS

| | | | |
|---|---|---|---|
| 3,942,143 | A | 3/1976 | Fritz et al. |
| 5,206,617 | A | 4/1993 | Bolz |
| 6,778,047 | B1 | 8/2004 | Zschau |

FOREIGN PATENT DOCUMENTS

| | | | |
|---|---|---|---|
| DE | 102006004254 | B3 | 7/2007 |
| JP | 08087941 | A | 4/1996 |

(Continued)

OTHER PUBLICATIONS

Machine Translation of JP 08087941 (Hitachi Ltd) Apr. 2, 1996.*
European Search Report dated May 22, 2015 in connection with the counterpart European Patent Application No. 12883437.1.

*Primary Examiner* — Bernard Rojas
(74) *Attorney, Agent, or Firm* — Hauptman Ham, LLP

(57) ABSTRACT

Disclosed is an electronic contactor including: a lower body; a magnetic force generator disposed within the lower body and magnetized by electric power transferred from outside to perform suctioning operation; a crossbar coupled to an upper portion of the magnetic force generator and provided with a movable contact to be lifted or lowered; a pair of separable upper bodies each being provided at one side thereof with a stationary contact and an auxiliary stationary contact and respectively coupled to upper opposite ends of the lower body such that the movable contact and auxiliary movable contacts are placed therein, facing ends of the upper bodies being coupled to each other inside the upper bodies so as to face each other; and a cover coupling upper ends of the upper bodies such that an upper end of the crossbar and the movable contact are exposed.

9 Claims, 6 Drawing Sheets

(51) Int. Cl.

| | |
|---|---|
| ***H01H 13/04*** | (2006.01) |
| ***H01F 3/00*** | (2006.01) |
| ***H01H 50/16*** | (2006.01) |
| ***H01H 50/02*** | (2006.01) |
| ***H01H 50/04*** | (2006.01) |
| ***H01H 50/54*** | (2006.01) |
| *H01H 51/06* | (2006.01) |

(56) References Cited

FOREIGN PATENT DOCUMENTS

| | | | |
|---|---|---|---|
| JP | 2011141963 | A | 7/2011 |
| KR | 2019990025103 | U | 7/1999 |
| KR | 100298331 | B1 | 8/2001 |
| KR | 1020040061460 | B1 | 7/2004 |

* cited by examiner

ELECTRONIC CONTACTOR INCLUDING SEPARABLE UPPER BODIES

TECHNICAL FIELD

The present invention relates to an electronic contactor, and more particularly, to an electronic contactor, which includes separable upper bodies each provided with a stationary contact and acting as an arc chamber to improve productivity through modularization, and which is integrally formed with auxiliary contact points without using separate blocks, thereby securing assembly performance and expansion of the auxiliary contact points, and improving user convenience.

BACKGROUND ART

In general, an electronic contactor is an electronic device that constitutes a magnetic switch (MS) together with a thermal overload relay to prevent overload and damage to a motor and the like.

In such an electronic contactor, an electromagnetic part and a contact point part are disposed inside a body and electric power is applied to opposite ends of a coil of an electromagnet such that an electric power circuit is connected to a load circuit to supply electric power to a load while a contact point of the contact point part is closed.

On the other hand, when electric power supplied to the opposite ends of the electromagnet is blocked such that the contract point of the contact point part is opened, electric power supplied to the load is blocked to perform supervisory control and integrated control.

However, since a typical electronic contactor includes an integral type main body provided with a main contact part, and a separate housing disposed between the main body and a cover, there is a difficulty in installing a mover within the body.

As such, difficulty in modularization of the electronic contactor causes decrease in productivity, and auxiliary contact points are mounted on an upper surface and a side surface of the main body using separate blocks, thereby deteriorating assembly efficiency and user convenience.

Documents related to the present invention include Korean Patent No. 100480837 (May 24, 2005) which discloses a connection apparatus that electrically connects an electronic contactor to a circuit board for electrically connecting a power source to a load.

DISCLOSURE

Technical Problem

An aspect of the present invention is to provide an electronic contactor, which includes separable upper bodies provided with a stationary contact and coupled to lateral sides of a crossbar through a male-female coupling structure, and phase-to-phase insulating housings disposed at opposite ends of the upper bodies to be separated from each other, thereby improving assembly performance using a lateral fastening structure, and which has a space for integrally mounting auxiliary contact points in the insulating housings such that auxiliary contact points can be used without an auxiliary block, thereby improving user convenience.

Technical Solution

In accordance with an aspect of the present invention, an electronic contactor includes: a lower body; a magnetic force generator disposed within the lower body and magnetized by electric power transferred from outside to perform suctioning operation; a crossbar coupled to an upper portion of the magnetic force generator and provided with a movable contact to be lifted or lowered; a pair of separable upper bodies each being provided at one side thereof with a stationary contact and an auxiliary stationary contact and respectively coupled to upper opposite ends of the lower body such that the movable contact and auxiliary movable contacts are placed therein, facing ends of the upper bodies being coupled to each other inside the upper bodies so as to face each other; and a cover coupling upper ends of the upper bodies such that an upper end of the crossbar and the movable contact are exposed.

The magnetic force generator may include: a bobbin coil disposed within the lower body and generating magnetic force; a stationary core coupled to a lower end of the bobbin coil and magnetized by the magnetic force transferred from the bobbin coil; a movable core disposed at an upper end of the bobbin coil to be suctioned downwards as the stationary core is magnetized; and a first resilient member coupled between the bobbin coil and the movable core and applying compressive force.

Each of the lower bodies may be formed at one side thereof with a plurality of first through-holes through which one end of the stationary contact is exposed to the outside, and a plurality of second through-holes placed at an upper end of the first through-holes such that one end of the movable contact is exposed to the outside therethrough.

The crossbar may include: a plurality of mover installation holes formed at opposite sides thereof and receiving the movable contact and the auxiliary movable contacts therein to be lifted or lowered; and a plurality of second resilient members disposed within the mover installation holes and applying vertical compressive force to the movable contacts.

Each of the upper bodies may be formed with a coupling section at a facing end thereof, the coupling sections may be coupled to each other to cross each other, and a contact face between the coupling sections coupled to cross each other may be formed with a latch boss and a latch recess coupled to each other in a male-female coupling manner.

Each of the upper bodies may be provided at one side thereof with an insulating housing for phase-to-phase insulation of the stationary contact.

Advantageous Effects

According to the present invention, the separable upper bodies are integrally assembled to each other in a male-female coupling manner and the phase-to-phase insulating housings are separately provided to opposite ends of the upper bodies, whereby assembly performance can be improved through a lateral assembly structure. Further, auxiliary contact points can be integrally assembled to the bodies, thereby improving user convenience through expansion of the number of auxiliary contacts to 1a1b and 2a2b.

<Description of Reference Numerals>

Figure 1:
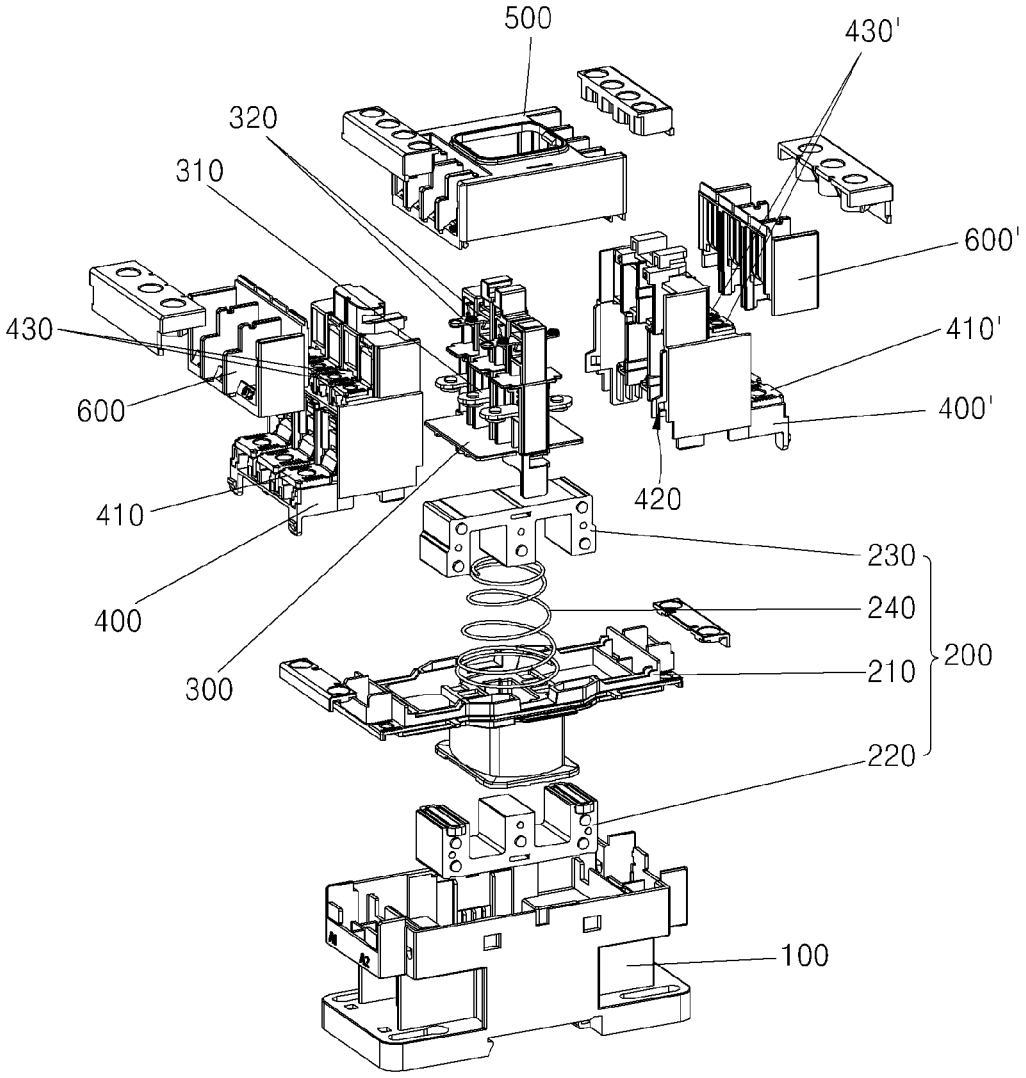
FIG. 1 is an exploded perspective view of an electronic contactor according to one embodiment of the present invention.
Figure 2:
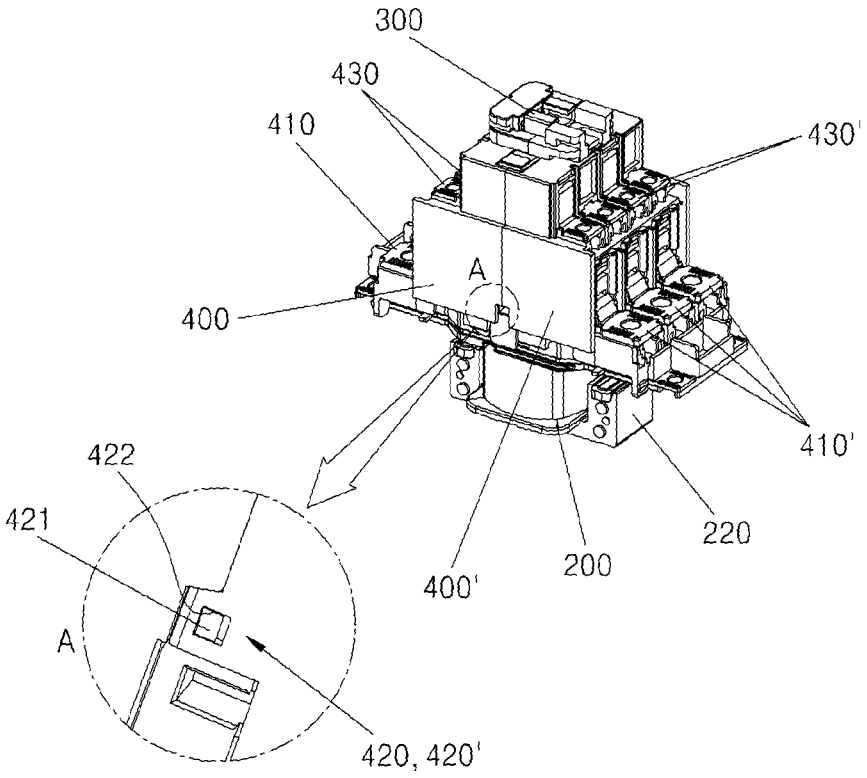
FIG. 2 is a perspective view of the electronic contactor according to the embodiment of the present invention, in which a magnetic force generator, a crossbar, and upper bodies are coupled to each other.
Figure 3:
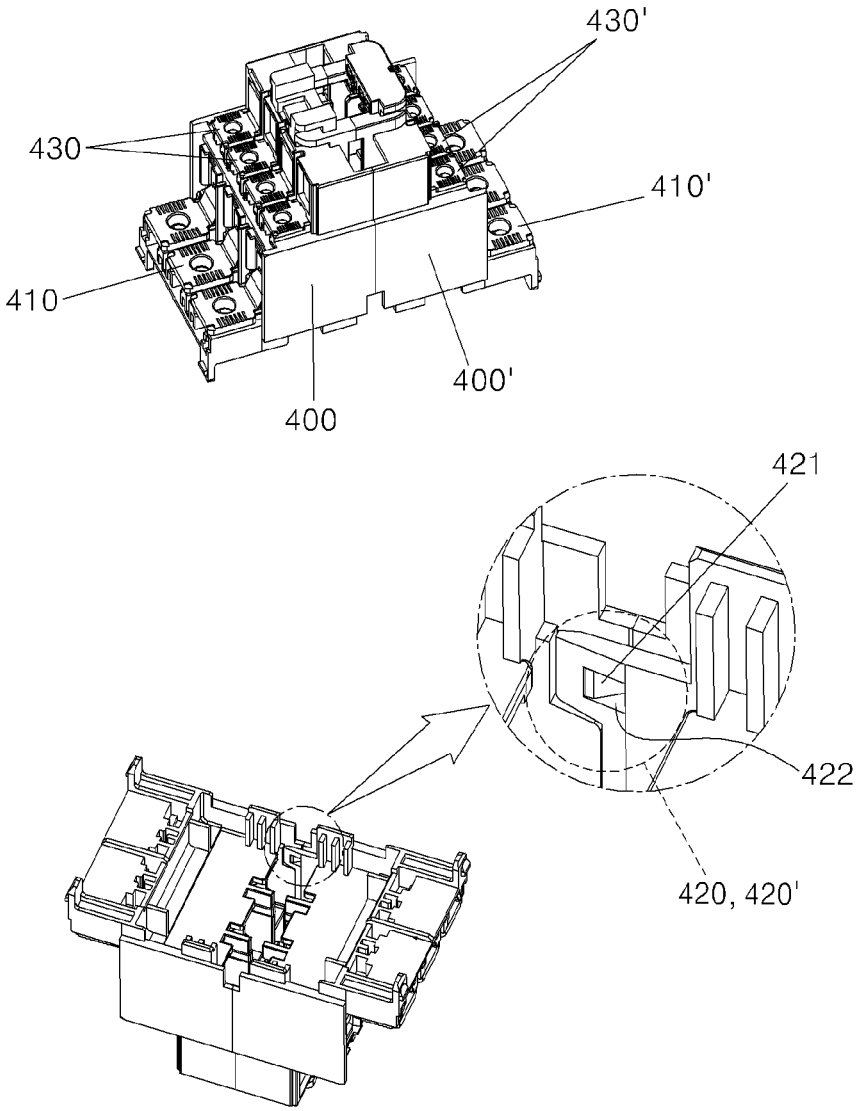
FIG. 3 is a perspective view of the electronic contactor according to the embodiment of the present invention, in which the upper bodies are coupled to each other.

| | |
|---|---|
| 100: Lower body | 200: Magnetic force generator |
| 210: Bobbin coil | 220: Stationary core |
| 230: Movable core | 240: First resilient member |
| 300: Crossbar | 310: Movable contact |
| 320: Auxiliary movable contact | 330, 340: Second resilient members |
| 400, 400': Upper bodies | 410, 410': Stationary contacts |
| 420, 420': Coupling sections | 430, 430': Auxiliary stationary contacts |
| 421: Latch boss | 422: Latch recess |
| 500: Cover | 600, 600': Insulating housings |
| 810: Auxiliary stator installation hole | |

BEST MODE

The above and other aspects, features, and advantages of the present invention will become apparent from the detailed description of the following embodiments in conjunction with the accompanying drawings.

However, it should be understood that the present invention is not limited to the following embodiments and may be embodied in different ways, and that the embodiments are provided for complete disclosure and thorough understanding of the invention by those skilled in the art. The scope of the present invention is defined only by the claims.

In a detailed description of the present invention, description of details apparent to those skilled in the art will be omitted for clarity.

Referring to FIGS. 1 to 6, an electronic contactor according to one embodiment of the invention includes a lower body 100, a magnetic force generator 200, a crossbar 300, a pair of separable upper bodies 400, 400', and a cover 500.

The lower body 100 defines a space which is open at an upper side thereof and receives the magnetic force generator 200 described below therein.

The magnetic force generator 200 is disposed within the lower body 100 and is magnetized by electric power transferred from outside to perform suctioning operation.

Here, the magnetic force generator 200 may include a bobbin coil 210, a stationary core 220, a movable core 230, and a first resilient member 240.

The bobbin coil 210 is disposed within the lower body 100 and serves to magnetize the stationary core 220 described below by generating magnetic force upon application of electric power thereto.

The stationary core 220 is disposed below the bobbin coil 210 and is magnetized by magnetic force transferred from the bobbin coil 210.

The movable core 230 described below is suctioned downwards as the stationary core 220 is magnetized.

The movable core 230 is disposed at an upper end of the bobbin coil 210 to be lifted or lowered, and is suctioned downwards as the stationary core 220 is magnetized.

The first resilient member 240 is coupled between the bobbin coil 210 and the movable core 230 and applies compressive force.

Here, the first resilient member 240 may be a coil spring for applying compressive force upwards or downwards.

That is, the movable core 230 may be suctioned downwards by the stationary core 220, or may be lifted again by compressive force of the first resilient member 240 upon removal of the suction force.

The crossbar 300 is coupled to an upper portion of the movable core 230 and is disposed to be lifted or lowered together with a movable contact 310.

The crossbar 300 is formed at one side thereof with a plurality of mover installation holes, in which the movable contact 310 and auxiliary movable contacts 320 described below are received to be lifted or lowered.

The mover installation holes may be provided with a plurality of second resilient members 330, 340 for applying vertical compressive force to the movable contact 310 and the auxiliary movable contacts 320.

Here, the second resilient members 330, 340 may be coil springs for applying compressive force.

Each of the movable contact 310 and the auxiliary movable contacts 320 is a conductor such that electricity can flow therethrough, and has opposite ends extending a predetermined distance at opposite sides of the corresponding mover installation hole.

That is, the movable contact 310 and the auxiliary movable contacts 320 may be lifted or lowered by the magnetic force generator and may be connected to or disconnected from stationary contacts 410, 410' and auxiliary stationary contacts 430, 430' through elevation operation, respectively.

A pair of separable upper bodies 400, 400' acts as an arc chamber and is coupled to upper opposite ends of the lower body 100 such that the movable contact 310 and the auxiliary movable contacts 320 are placed therein.

Here, lower ends of the upper bodies 400, 400' may be slidably coupled to an upper end of the lower body 100 in a male-female coupling manner, or by a separate fastening member (not shown).

Each of the upper bodies 400, 400' is provided at one side thereof with a plurality of stator and auxiliary stator installation holes 810 arranged in a lateral direction.

The plurality of stationary contacts 410, 410' and the auxiliary stationary contacts 430, 430' described below are disposed in the stator and auxiliary stator installation holes 810.

The stationary contacts 410, 410' and the auxiliary stationary contacts 430, 430' are conductors such that electricity can flow therethrough, and are connected to or disconnected from the movable contact 310 and the auxiliary movable contacts 320 in a fixed state.

Each of the upper bodies 400, 400' is formed with one or more coupling sections 420, 420' such that facing ends of the upper bodies 400, 400' can be coupled to each other inside the upper bodies 400, 400'.

Here, the coupling sections 420, 420' may be formed at opposite sides of each of the upper bodies 400, 400'.

The coupling sections 420, 420' may be formed at upper and lower portions of each of the upper bodies 400, 400'.

The coupling sections 420, 420' may be horizontally coupled to each other to cross each other.

To this end, each of the coupling sections 420, 420' may be formed with a latch boss 421 and a latch recess 422 to be coupled to each other in a male-female coupling manner.

Here, the latch bosses 421 may protrude from opposite inner sides of the upper bodies 400, 400'.

The coupling sections 420, 420' having the latch recesses 422 may protrude to insides of the upper bodies 400, 400'.

That is, the coupling sections 420, 420' having the latch recesses 421 are coupled to enclose lateral sides of the upper bodies 400, 400', so that the latch bosses 421 protruding to the opposite inner sides of the upper bodies 400, 400' may be inserted into the corresponding latch recesses 422.

That is, the upper bodies 400, 400' may be easily coupled to or separated from each other through such a male-female fastening structure of the coupling sections 420, 420'.

The pair of upper bodies 400, 400' may be coupled to and separated from lateral inner sides thereof using the coupling sections 420, 420' without using a separate coupling unit, thereby improving assembly performance.

Insulating housings 600 and 600' for phase-to-phase insulating the stationary contacts 410, 410' may be coupled to sides of the upper bodies 400, 400', respectively.

Figure 6:
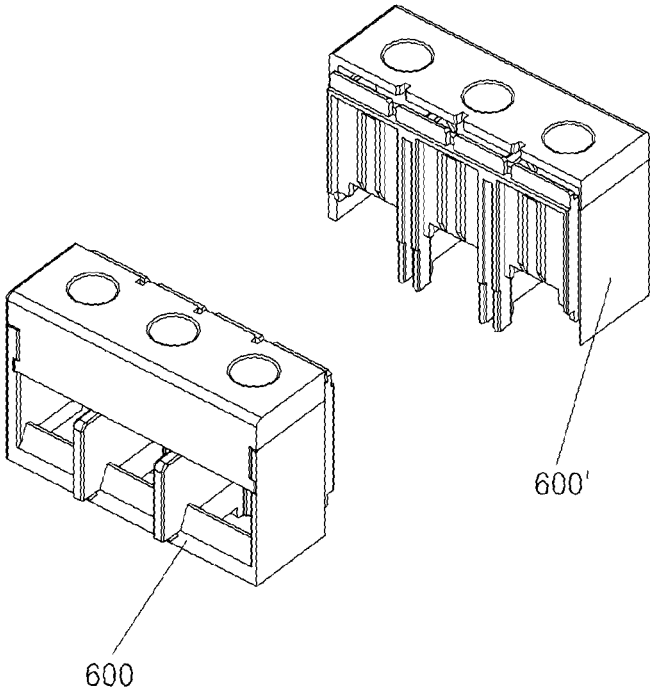
FIG. 6 is a perspective view of an insulating housing of the electronic contactor according to the embodiment of the present invention.

The insulating housings 600, 600' shown in FIG. 6 may be coupled to sides of the upper bodies 400, 400' through a male-female fastening structure or a separate fastening member (not shown).

The cover 500 is coupled to upper ends of the upper bodies 400, 400' such that the upper ends of the upper bodies 400, 400' are coupled to each other thereby.

The cover 500 also allows phase-to-phase insulation of the auxiliary stationary contacts 430, 430' formed on the upper bodies 400, 400'.

Here, a lower end of the cover 500 may be slidably coupled to the upper ends of the upper bodies 400, 400' in a male-female coupling manner or by a separate fastening member (not shown).

The cover 500 exposes the upper end of the crossbar 300 and the auxiliary stationary contacts 430, 430'.

To this end, the cover 500 may be vertically formed at an upper end thereof with a through-hole.

The upper ends of the upper bodies 400, 400' are coupled to opposite ends of the cover 500, and a plurality of auxiliary stator installation holes 810 may be formed along lateral sides of opposite ends of the cover 500.

Hereinafter, a process of assembling the electronic contactor according to the present invention will be described below.

Figure 4:
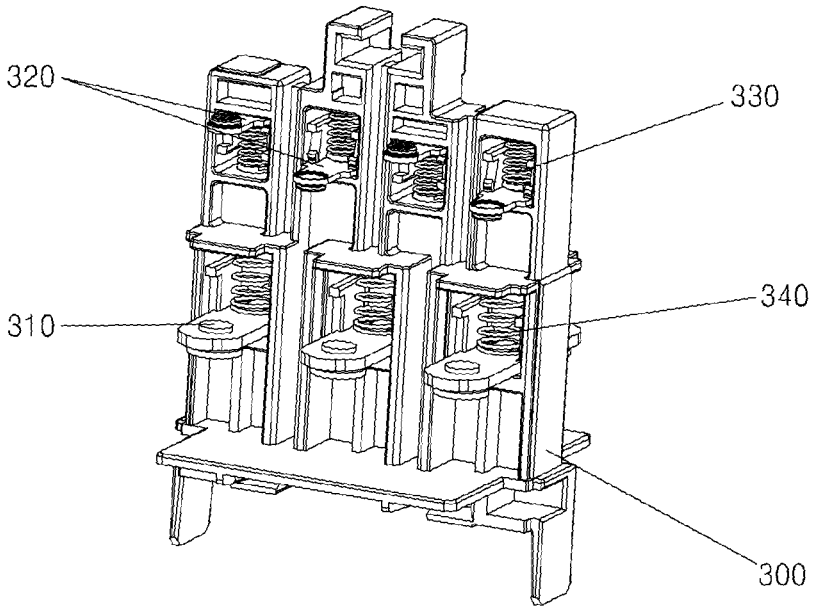
FIG. 4 is a perspective view of the crossbar of the electronic contactor according to the embodiment of the present invention.
Figure 5:
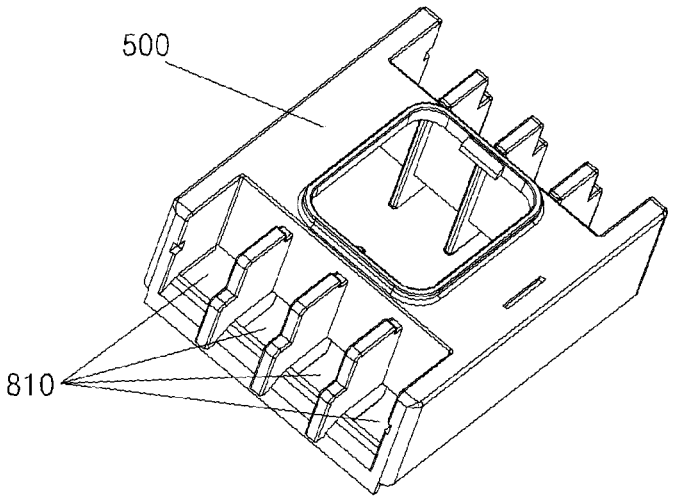
FIG. 5 is a perspective view of a cover of the electronic contactor according to the embodiment of the present invention.

First, as shown in FIG. 4, the movable contact 310, the auxiliary movable contacts 320, and the second resilient members 330, 340 of the crossbar 300 are assembled in the mover and auxiliary mover installation holes 310, 310', and the movable core 230 is preliminarily assembled at a lower portion of the crossbar 300 to form one unit.

The stationary core 220, the bobbin coil 210, and the first resilient member 240 are disposed within the lower body 100, and the crossbar 300 is coupled such that the movable core 230 is placed at an upper end of the first resilient member 240.

Next, a pair of separable upper bodies 400, 400' is coupled to upper opposite ends of the lower body 100.

The coupling sections 420 and 420' formed on the pair of separable upper bodies 400, 400' are coupled to each other in a male-female coupling manner.

Then, lower ends of the pair of separable upper bodies 400, 400' are coupled to upper opposite ends of the lower body 100.

Thereafter, the cover 500 is coupled to upper ends of the upper bodies 400, 400' and the insulating housings 600, 600' are coupled to opposite sides of the upper bodies 400, 400', respectively.

As a result, according to the present invention, the divided upper bodies are integrally coupled to each other in a male-female coupling manner and the phase-to-phase insulating housings are provided to the opposite sides of the upper bodies, whereby assembly performance can be improved through a lateral assembly structure.

Although some embodiments have been disclosed herein, it should be understood that various modifications, changes, alterations and equivalent embodiments can be made without departing from the scope of the present invention. Therefore, the scope and sprit of the invention should be defined only by the accompanying claims and equivalents thereof.

That is, it should be understood that these embodiments are provided for illustration only and are not to be construed in any way as limiting the present invention, and that the scope of the present invention is defined only by the accompanying claims. All modifications, changes, and alterations deduced from the claims and their equivalents fall within the scope of the present invention.

The invention claimed is:

1. An electronic contactor, comprising:

a lower body;

a magnetic force generator disposed within the lower body, and configured to be magnetized by electric power transferred from outside the magnetic force generator, and perform attracting operation by using magnetic force generated by the magnetized magnetic force generator;

a crossbar coupled to an upper portion of the magnetic force generator, and comprising with at least one movable contact configured to be lifted or lowered and at least one auxiliary movable contact configured to be lifted or lowered, wherein, in a direction toward the lower body, the at least one movable contact is disposed lower than the at least one auxiliary movable contact;

a pair of separable upper bodies each comprising:

a stationary contact; and an auxiliary stationary contact, wherein the upper bodies are respectively coupled to upper opposite ends of the lower body, wherein at least one movable contact and the at least one auxiliary movable contact are placed in a combined upper bodies, and wherein facing ends of the upper bodies are coupled to each other inside the upper bodies, and the facing ends face each other; and a cover coupling upper ends of the upper bodies, wherein an upper end of the crossbar and the at least one movable contact are exposed to an outside of the cover, wherein the upper bodies comprise coupling sections at the facing ends thereof, the coupling sections being coupled to each other to cross each other, and wherein a contact face between the coupling sections coupled to cross each other comprises a latch boss and a latch recess coupled to each other in a male-female coupling manner.

2. The electronic contactor according to claim 1, wherein the magnetic force generator, comprises:

a bobbin coil disposed within the lower body, and configured to generate the magnetic force;

a stationary core coupled to a lower end of the bobbin coil, and configured to be magnetized by the magnetic force transferred from the bobbin coil;

a movable core disposed at an upper end of the bobbin coil, and configured to be attracted downwards as the stationary core is magnetized; and a first resilient member coupled between the bobbin coil and the movable core, and configured to bias the movable core toward the crossbar.

3. The electronic contactor according to claim 1, wherein each of the upper bodies, at one side thereof, comprises:

a plurality of first through-holes through which one end of the stationary contact is exposed to the outside of the upper bodies; and a plurality of second through-holes above the first through-holes, wherein one end of the at least one auxiliary stationary contact is exposed to the outside of the upper bodies through the second through-holes.

4. The electronic contactor according to claim 1, wherein the crossbar comprises:

a plurality of mover installation holes formed at opposite sides of the crossbar, wherein the plurality of mover installation holes receives the at least one movable contact and the at least one auxiliary movable contact therein while allowing the at least one movable contact and the at least one auxiliary movable contact to be lifted or lowered; and a plurality of second resilient members disposed within the mover installation holes, and configured to apply vertical compressive force to the movable contacts.

5. The electronic contactor according to claim 1, wherein each of the upper bodies, at one side thereof, comprises an insulating housing for phase-to-phase insulation of the stationary contact.

6. The electronic contactor according to claim 2, wherein each of the upper bodies, at one side thereof, comprises:

a plurality of first through-holes through which one end of the stationary contact is exposed to the outside of the upper bodies; and a plurality of second through-holes above the first through-holes, wherein one end of the at least one movable contact is exposed to the outside of the upper bodies through the second through-holes.

7. The electronic contactor according to claim 6, wherein the crossbar comprises:

a plurality of mover installation holes formed at opposite sides of the crossbar, wherein the plurality of mover installation holes receives the at least one movable contact and the at least one auxiliary movable contact therein while allowing the at least one movable contact and the at least one auxiliary movable contact to be lifted or lowered; and a plurality of second resilient members disposed within the mover installation holes, and configured to apply vertical compressive force to the movable contacts.

8. The electronic contactor according to claim 7, wherein the upper bodies comprise coupling sections at the facing ends thereof, the coupling sections being coupled to each other to cross each other, and a contact face between the coupling sections coupled to cross each other comprises a latch boss and a latch recess coupled to each other in a male-female coupling manner.

9. The electronic contactor according to claim 8, wherein each of the upper bodies, at one side thereof, comprises an insulating housing for phase-to-phase insulation of the stationary contact.

* * * * *